US006539755B1

(12) United States Patent
Bruwer et al.

(10) Patent No.: US 6,539,755 B1
(45) Date of Patent: Apr. 1, 2003

(54) ELECTRIC LOCK

(75) Inventors: Frederick Johannes Bruwer, Paarl (ZA); Brandt Aucamp, Paarl (ZA)

(73) Assignee: Azotec (Pty) Limited, Paarl (ZA)

( * ) Notice: Subject to any disclaimer, the term of this patent is extended or adjusted under 35 U.S.C. 154(b) by 0 days.

(21) Appl. No.: 09/830,985

(22) PCT Filed: Nov. 3, 1999

(86) PCT No.: PCT/ZA99/00116

§ 371 (c)(1),
(2), (4) Date: May 3, 2001

(87) PCT Pub. No.: WO00/26489

PCT Pub. Date: May 11, 2000

(30) Foreign Application Priority Data

Nov. 3, 1998 (ZA) ..... 98/10029
Feb. 25, 1999 (ZA) ..... 99/1511

(51) Int. Cl.[7] ..... E05B 59/00
(52) U.S. Cl. ..... 70/107; 70/277; 70/279.1; 70/283; 70/150; 292/165; 292/332
(58) Field of Search ..... 70/107–111, 134, 70/150, 151, 478, 481, 484, 485, 277, 278.1, 279.1–283; 292/332, 333, 159, 165

(56) References Cited

U.S. PATENT DOCUMENTS 2,638,772 A 5/1953 Ramler ..... 70/151
4,854,619 A 8/1989 Nakauchi ..... 292/335
5,044,184 A * 9/1991 Herbers et al. ..... 70/277
5,681,070 A 10/1997 Williams et al. ..... 292/341.16
6,131,966 A * 10/2000 Hensley et al. ..... 70/107 X
6,196,035 B1 * 3/2001 Tsui ..... 70/107
6,302,456 B1 * 10/2001 Errani ..... 70/107 X

FOREIGN PATENT DOCUMENTS

| | | | |
|---|---|---|---|
| DE | 3806422 | * | 9/1989 |
| EP | 557861 | * | 9/1993 |
| EP | 670404 | * | 9/1995 |
| GB | 2301142 | * | 11/1996 |

* cited by examiner

*Primary Examiner*—Suzanne Dino Barrett
(74) *Attorney, Agent, or Firm*—Young & Thompson

(57) ABSTRACT

A lock which includes a bolt which is movable between a locked position and an unlocked position against the action of a biassing element such as a spring, first retaining element which is engaged with the bolt and which retains the bolt in the locked position and which is movable between a first position at which the first retaining element restrains the bolt from being moved from the locked position to the unlocked position and a second position at which the first retaining element restrains the bolt from being moved from the unlocked position to the locked position, remotely actuable release element, which when actuated, causes movement of the first retaining element from the first position to the second position, and handle element for moving the bolt from the locked position to the unlocked position when the first retaining element is disengaged from the bolt.

56 Claims, 10 Drawing Sheets

ELECTRIC LOCK

BACKGROUND OF THE INVENTION

This invention relates to a lock which is suitable for use as a door lock. It is to be understood however that the scope of the invention is not confined to this particular application.

A door lock which is in widespread use has a bolt which is movable between locked and unlocked positions. The bolt is movable by means of a key which is manually rotatable and which acts on one or more lock levers which have formations which match complementary formations on the key. A catch, which forms part of the lock, is movable by means of a handle so that a door, to which the lock is mounted, can be moved from a closed position to an opened position.

Electrically operated locks have been proposed wherein the movement of the bolt is effected by means an electrical device such as a solenoid or motor. The solenoid is actuated by means of a security mechanism such as a keypad and draws power from a mains or battery supply in order to move the bolt.

The provision of power to a lock of this type may pose some problems.

Firstly if use is made of power drawn from a mains supply then one is faced with the difficulty of leading electrical conductors to the lock. On the other hand if use is made of an onboard power supply such as one or more batteries then the current drain on the batteries may be such that the batteries must be replaced at regular intervals of relatively short duration. This problem becomes pronounced under certain conditions for example when friction forces are generated, which impede the movement of the lock components.

SUMMARY OF THE INVENTION

The invention provides a lock which includes a bolt which is movable between a locked position and an unlocked position, first retaining means which is engaged with the bolt and which retains the bolt in the locked position, remotely actuable release means for moving the first retaining means out of engagement with the bolt, and handle means for moving the bolt from the locked position to the unlocked position when the first retaining means is disengaged from the bolt.

The bolt is movable from the locked position to the unlocked position against the action of a biassing element such as a spring. Energy accumulated in the biassing element may be used for subsequently returning the bolt to the locked position. This eliminates the need for an external energy source to operate the lock; for example electrical energy required to drive an electric motor to move the bolt. The handle is operated by a person opening the door. Thus the energy to bias the biassing element is supplied by the user.

Preferably the first retaining means is movable between a first position at which the first retaining means restrains the bolt from being moved from the locked position to the unlocked position and a second position at which the first retaining means restrains the bolt from being moved from the unlocked position to the locked position, and the release means, when actuated, causes movement of the first retaining means from the first position to the second position.

The lock may include biassing means which is biassed when the bolt is moved to the unlocked position. The biassing means may provide energy for restoring the bolt to the locked position.

The release means may be electrically actuable. The release means may take on any suitable form and for example may include an electric motor.

The release means may be responsive to a signal which is output by a receiver and decoder unit which, in turn, is responsive to an externally generated signal for causing operation of the lock.

Preferably the lock includes energy storage means which accumulates energy as the bolt is moved to the unlocked position, second retaining means, engageable with the bolt, for retaining the bolt in the unlocked position, and means for disengaging the second retaining means from the bolt whereupon the energy storage means causes the bolt to be moved to the locked position.

The first and second retaining means may be formed by inter-engageable formations respectively on the bolt and on at least one lever.

The first retaining means may be movable in any appropriate way and, for example, use may be made of a cam, a gear mechanism e.g. a worm gear arrangement, which acts on the cam, and an electrical motor which drives the gear mechanism, and hence the cam, in a controlled manner.

The first and the second retaining means may also be movable by means of a key of any appropriate type. This enables the bolt to be manually locked or unlocked according to requirement.

The lock may include a receiver and decoder which receives an externally generated signal from any appropriate source such as a card reader, keypad, any suitable recognition device, a switch device, a radio transmitter or the like. The scope of the invention is not limited in this regard. If a correctly encoded signal or a valid signal is received then the retaining means may be moved in the manner described.

Communication with the lock may be unidirectional, or bidirectional e.g. in a "challenge-response" routine or mode. In each case a signal may be transmitted, by a direct link or a wireless link, from a source which is close to a lock, or from a remote source e.g. a central control point. The signal could simultaneously actuate a number of locks. A phone link, an Internet connection, or any similar device or arrangement could be used to address the lock directly or through the medium of a control unit. The lock may be capable of reporting or responding, e.g. to a control unit or any actuating source, through any appropriate medium, directly or through a wireless, Internet or other link. The lock may for example report to an alarm system to indicate that a door is open or closed or, possibly, that the door has been forced open.

Where a plurality of locks are used, a central system or an alarm system may be installed that can individually or collectively instruct the locks to lock and unlock. The locks may report to the central system indicating information such as whether they have been successfully locked, and whether the respective doors are open or closed. The central system may also communicate with other systems which may include garage doors to lock and unlock such doors and to check on their status such as open or closed. The central system may be interfaced by a user directly or may be communicated with by the user via a telephone link, the Internet or a satellite. This communication may take place via a variety of mediums, such as wired, radio frequency and infrared links.

Single hand held controllers may be used to lock a variety of locks with one button press, or single locks with the press of another button, or a code of button presses. For certain buttons of the hand held controller, the power that is emitted may be higher than for other buttons of the same hand held controller. This makes it possible to limit the working range of some of the buttons on the hand held controller and helps to prevent the accidental locking and unlocking of surrounding locks if a specific lock is to be locked and unlocked, if a hand held controller can lock and unlock more than one lock. For hand held controllers communication can take place via a variety of mediums, such as radio frequency and infrared links.

It is also possible to actuate the lock by means of any appropriate device, e.g. a push button, which is installed at a convenient and safe location and which may be linked directly to the lock.

The lock may include an energy storage device such as at least one battery. The battery may be stored in a housing in which mechanical components of the lock are mounted or in a separate easily accessible housing.

The lock may include cam means which acts on the first retaining means, an electrically driven gear mechanism, which is remotely controllable, for causing controlled movement of the first retaining means from the said first position to the said second position, energy storage means which accumulates energy as the bolt is moved, and means for preventing movement of the cam means at least in one direction when the bolt is moved to the unlocked position.

The energy storage means may provide energy for restoring the bolt to the locked position. Alternatively, if energy is stored when the bolt is moved to the locked position, the energy storage means is used to restore the bolt to the unlocked position.

The electrically driven gear mechanism may include an electric motor which drives a gear arrangement such as a worm gear and preferably is responsive to a signal which is output by a receiver and decoder unit which, in turn, is responsive to an externally generated signal for causing operation of the mechanism.

The first retaining means may include at least one lever which is engageable with a stop formation on the bolt.

A sensor of any appropriate type e.g. optical, magnetic, inductive etc. may detect whether a door, to which the lock is fitted, is open or closed and only allow actuation of the bolt in a manner which depends on the door position, e.g. to move the bolt to a locked position only when the door is closed.

The lever or levers may be actuated manually, for example directly by means of a key which acts on the lever or levers, or indirectly by means of a key which acts on a cylinder which, in turn, acts on lever or levers, or in any other way.

Preferably the lock includes a device which is movable between a first position at which, upon operation of the handle, the bolt is caused to move to the unlocked position, and a second position at which, upon operation of the handle, no movement of the bolt results. The said device may for example be a spring or a catch.

The invention also provides a method of operating a lock which includes at least a locking bolt, the method including the steps of storing energy when the bolt is moved manually in a first direction, latching the bolt at a first position using retaining means, transmitting a signal to actuate the retaining means to unlatch the bolt, and allowing the locking means to move in a second direction opposite the first direction under the action of the stored energy.

The transmitted signal may be transmitted from a remote point using an electronic key eg, suitable wireless means, or a connection which is made directly to the retaining means or an actuator thereof.

It fails within the scope of the invention to actuate the lock electronically or by means of a mechanical key. By making use of a transmitter which can transmit more than one signal it is possible to control the operation of the lock in a variety of ways, according to requirement. For example the operation or potential operation of a mechanical key can be disabled electronically to enhance the security of the lock. Thus, by way of example, the aforementioned cam means may include a cam surface which actuates one or more members which prevent direct or indirect engagement of a mechanical key with the bolt or with a device which causes bolt movement.

BRIEF DESCRIPTION OF THE DRAWINGS

The invention is further described by way of examples with reference to the accompanying drawings in which.

DESCRIPTION OF PREFERRED EMBODIMENTS

Figure 1:
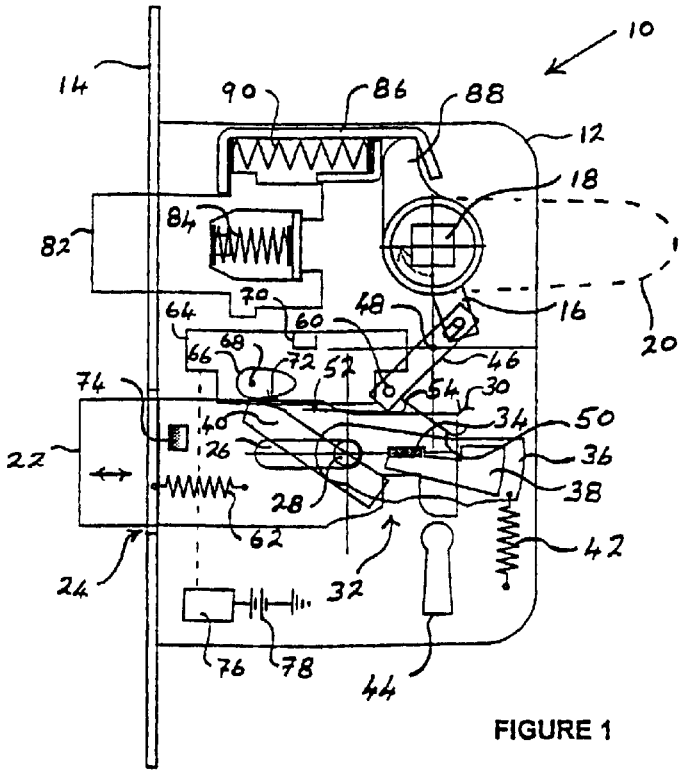
FIG. 1 illustrates a lock according to a first form of the invention in a locked configuration.

FIGS. 1 to 4 of the accompanying drawings illustrate a lock 10 according to a first form of the invention from the side in different operating configurations which are described hereinafter.

The lock is intended for mounting in a door or any other closure. The door is however not shown in the drawings for it plays no part in the invention. The lock is designed to be used as a replacement for a conventional lever lock but this aspect is given merely by way of example and it is to be understood that the principles of the invention are not restricted in any way.

The lock 10 includes a housing 12 with a face plate 14. The housing 12 is intended to be located in a hollow formed in a side edge of a door, not shown. The face plate is normally located in a recess formed in the side edge of the door.

The housing is formed from two halves which are engageable with each other to form enclosure for the various components of the lock. The drawings illustrate the lock with one half of the housing removed so that the components are visible.

A handle cam 16 is mounted to a shaft or axle 18 which extends from the housing 12. Two handles 20 are fixed to opposed projecting ends of the shaft, in a conventional manner. Only one handle 20 is shown, in dotted outline, in the drawings.

A bolt 22 is mounted for sliding movement relatively to the housing, as is indicated by means of a double-headed arrow. The bolt passes through a slot 24 in the face plate and includes an elongate slot 26 which is engaged with a pivot and guide pin 28 which projects from the housing.

At its innermost end 30 the bolt has a downwardly facing recessed formation 32. A bolt catch or stop formation 34 extends from the bolt.

One or more lock levers 36 which are substantially of a conventional design are mounted for pivotal movement on the pin 28. Each lever has a shaped aperture 38. An arm 40 extends upwardly from the levers. The arm is formed from a resilient material and is shown on an enlarged scale on FIG. 5, and is further described hereinafter. A spring 42 acts on the levers.

A keyhole 44 is formed in the housing slightly below the levers 36.

A lever 46, referred to as a power lever, is mounted for pivotal movement about a point 48. A shaped spring 50 is fixed to the bolt at a point 52, and has a hook formation 54 which is adjacent a spigot or similar formation 60 on the power lever 46. When the spring 50 is in the position shown in FIG. 1 the lock formation 54 is out of reach of the spigot 60 and cannot engage with the spigot.

A spring 62 acts between the bolt 22 and the housing or the face plate 14.

A worm gear drive 64, is mounted above the bolt and its output shaft is fixed to a cam 66 which is mounted for rotation about an axis 68. A small electric motor 70 is used to rotate the worm gear drive, and hence cause controlled movement of the cam.

Figure 5:
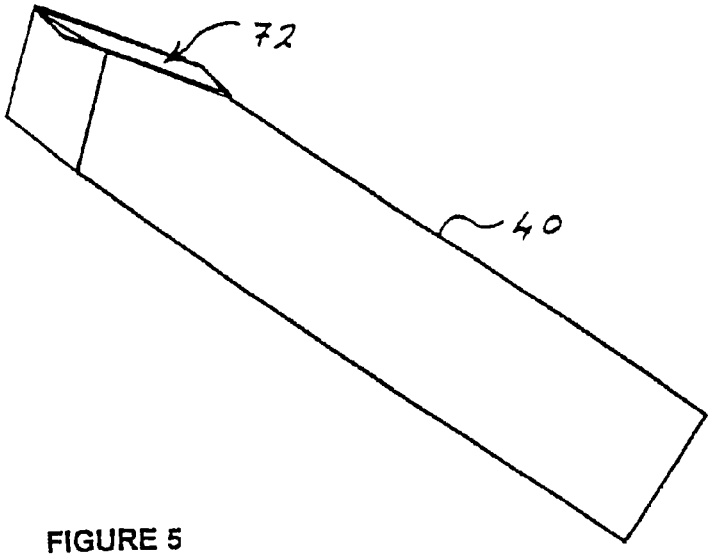
FIG. 5 illustrates on an enlarged scale an arm which is used in the lock of the invention, FIGS. 6 to 10 respectively illustrate different stages of operation of a lock according to a second form of the invention.
Figure 6:
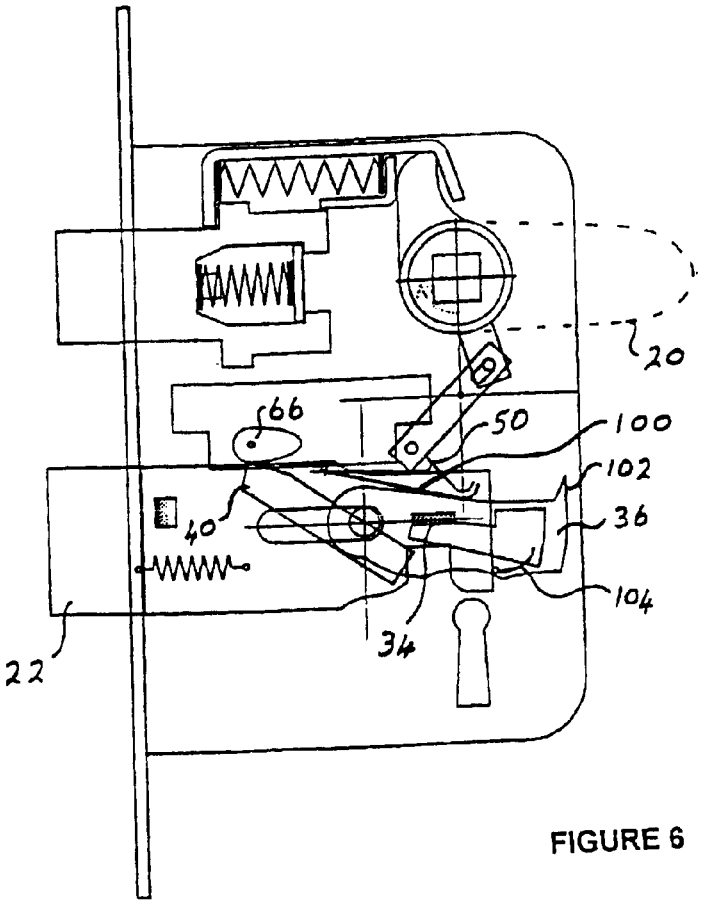
Figure 7:
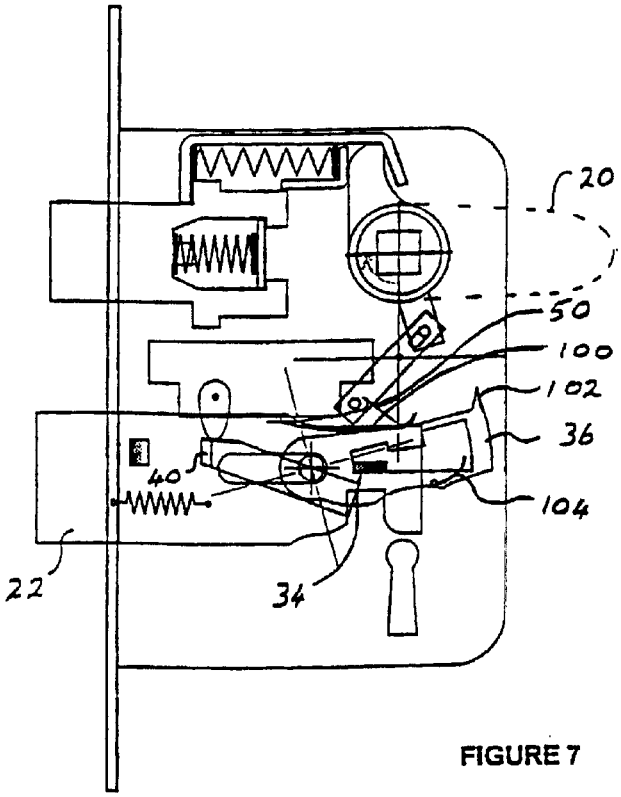

In FIG. 1 the cam 66 is in an inoperative position and opposes an upper end surface 72 of the arm 40 (see FIG. 5).

The bolt 22 has an outwardly extending ramp surface 74 positioned slightly lower than the end surface 72, when the lock is in the FIG. 1 mode.

A micro-controller 76 which includes a receiver and decoder unit is mounted inside the housing. This unit draws power from a battery 78 which is mounted inside the housing and which powers the motor 70.

The micro-controller 76 and the battery 78 may, according to requirement, be mounted in an enclosure (not shown) which is separate from the housing 12 and which is relatively easily accessible.

The lock has a catch or latch 82 biased to a latching position by means of a spring 84, and is acted on via a link 86, by an upper cam 88 which is rotatable by the handle 20 against the biasing action of a spring 90.

FIG. 1 illustrates the lock in a locked position with the bolt 22 and the catch 82 extending from the housing. If the lock is installed in a door then clearly the bolt 22, in the illustrated position, is engageable with a striker plate on a door frame in order to keep the door in a closed and locked position.

Figure 2:
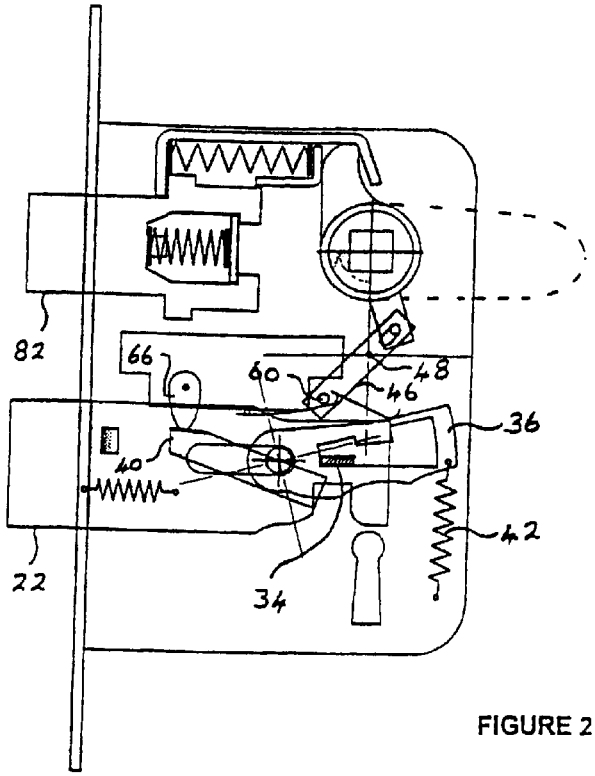
FIG. 2 shows the lock of FIG. 1 in a locked, but ready to open, configuration.
Figure 3:
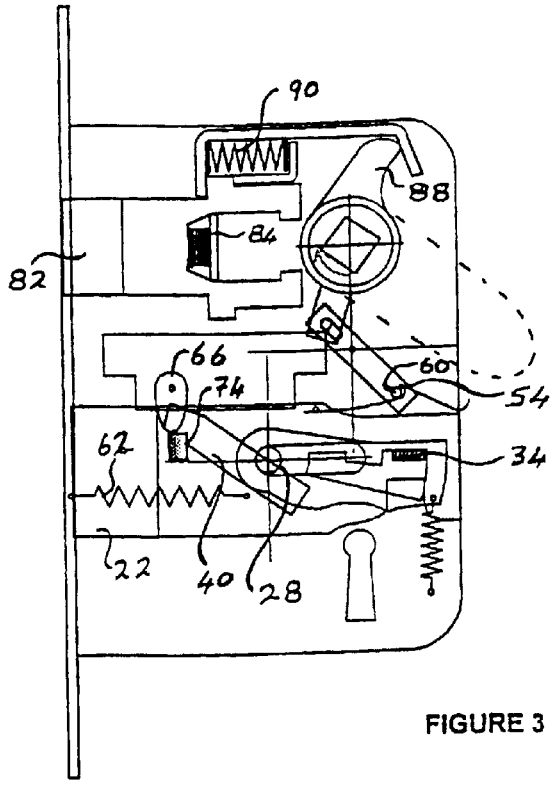
FIG. 3 shows the lock of FIG. 1 in a completely unlocked position.
Figure 4:
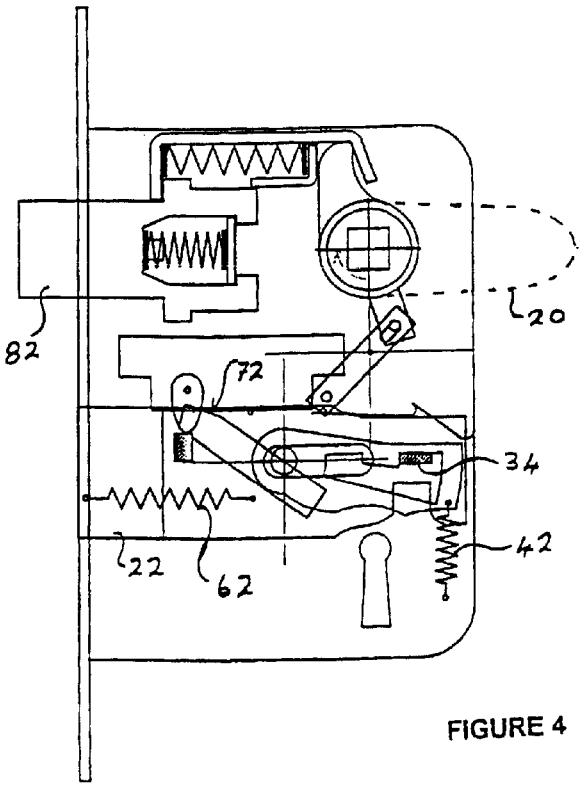
FIG. 4 shows the lock latched, but not locked.

The lock may be unlocked with a key which is inserted into the keyhole 44, in a conventional manner. If the key is rotated then formations on the key engage with complementary formations in the recessed formations 32 on the levers and lift the levers, which pivot about the pin 28. In this way the levers are moved out of engagement with the formation 34 and, as the key is further rotated, the key engages directly with a surface on the bolt and moves it to the right. The bolt is able to move to the right for the catch formation 34 then has a position, relatively to the apertures 38, as is shown in FIG. 2. The handle 20 can be rotated to move the catch 82 to a retracted position, as shown in FIG. 3, and the door can be opened. If the bolt is still engaged with the strike plate, as shown in FIG. 1, operation of the handle will only cause movement of the catch, and it will not be possible to open the door. If the handle is released the catch goes to the position shown in FIG. 4 to keep the door in a latched position. The door, if open, could also be closed with the catch then moving to allow closure. The working of the lock of the invention, in this regard, is substantially conventional and hence is not further elaborated on herein. It is to be noted however that the manual unlocking of the lock takes place without actuating the receiver and decoder unit 76.

At this point the lock can be locked manually, by using a key, or electronically. If the lock is to be locked manually then the key is engaged with the key hole and rotated in the locking direction. The levers 36 are lifted and the formations on the key engage with the recessed formations 32 on the levers moving the bolt to the left. The spring 62 contracts assisting bolt movement.

On the other hand the lock can be operated remotely in any appropriate way eg. electronically, by pressing a lock button on a remote control device such as a radio transmitter or use made of a keypad which, if correctly operated, generates a signal which is transmitted to the receiver by means of a conductor on wirelessly, in any suitable way. The transmitted signal is received and identified by the receiver and decoder unit 76 and, if acceptable, the motor 70 is actuated thereby to drive the worm gear drive 64. The cam 66 is rotated in a clockwise direction about the axis 68 and the arm 40 is moved downwardly as the cam strikes the upper surface 72 of the arm. As the arm pivots downwardly the levers 36 are pivoted upwardly and the apertures 38 are disengaged from the stop formation 34. The spring 62, which accumulated energy when the bolt was moved to the unlocked position, now releases its stored energy and consequently under the action of the restoring force of the spring 62 the bolt is moved to the locked position.

The use of a radio transmitter, for controlling the operation of the lock, is given merely by way of example and any suitable remote or non-contact method can be used for actuating the lock. An actuator of this type may more generally be referred to as an electronic key. The electronic key ideally has the facility for making use of a coded signal which is decoded by the unit 76 to enable lock operation to take place. If an incorrectly encoded signal is received then the lock will not be operated. Clearly this is a security feature.

If the receiver recognises a transmitted code then referring again to FIG. 1, when the bolt is in a locked position the motor 70 is driven with power drawn, for this purpose, from the battery 78. The motor drives the cam in a clockwise direction into engagement with the upper surface of the arm which, in turn, is moved downwardly, pivoting the levers upwardly, against the biasing action of the spring 42, as is shown in FIG. 2. As the levers move, the shaped apertures are moved out of engagement with the stop formation 34. An end of the spring 50, which extends to the right in the drawing, is moved upwardly by the levers from the relaxed position shown in FIG. 1, to an operative position, shown in FIGS. 2 and 3, the hook formation 54 is moved to a position at which it can engage with the spigot 60.

If the handle is depressed before the cam is engaged with the levers 36 and the spring 50, the spring 50 yields to the spigot 60 when the handle is released, and the spigot 60 is then able to engage with the hook formation 54, as per normal operation.

At this stage, if the handle 20 is rotated, the power lever 46, rotating about the pivot point 48, is moved so that the spigot 60 engages with the hook formation 54 of the spring 50. The spring 50 is moved to the right and the bolt 22 is thereby also moved to the right, relatively to the housing, extending the spring 62, to the FIG. 3 position. During this process the catch 82 is also withdrawn and consequently the door can be opened.

As the bolt moves to the right the ramp formation 74 slides under the upper end of the arm 40 which is now more or less in line with the ramp formation and the ramp urges the upper end of the arm away from the bolt out of engagement with the cam 66. When the arm disengages from the cam the levers 36 are immediately pivoted in a clockwise-direction about the point 28 by the spring 42 and take up the position shown in FIGS. 3 and 4 at which the formation 34 is again engaged with the apertures 38 thereby retaining the bolt in the withdrawn or unlocked position. The catch 82 can then be moved to an extended or retracted position, as required, simply by moving the handle 20, substantially in a conventional way, without effecting the position of the bolt.

If the bolt is to be unlocked then, as already pointed out, this can be done electrically or mechanically, according to requirement, in the respective manner which has already been described.

The operation of the lock can be summarised as follows:

1. movement of the bolt to the unlocked position takes place manually and, in the process, energy is stored in the spring 62;
2. energy for moving the bolt to the locked position, particularly if use is made of a remote actuator such as a keypad or transmitter, is provided by the spring 62 which accumulates energy when the bolt is moved to the unlocked position;
3. the bolt can be unlocked manually by means of a key, or electrically by causing the cam 66 to disengage the lever apertures 38 from the formation 34;
4. as the bolt is moved from the locked to the unlocked position the ramp formation 74 causes the arm 40 to disengage from the cam 66. The worm gear 64 has a gear ratio which is stepped down substantially from the motor 70 to the cam. In the opposite direction, from the cam to the motor, the gear ratio is stepped up. Consequently any attempt to rotate the cam 66 directly and not via the motor, will be ineffective and cause damage to the cam or to the worm gear. The ramp formation therefore causes disengagement of the cam from the arm when the possibility exists of the cam being moved manually;
5. the use of a key with the bolt in the unlocked position causes the lock levers 36 to pivot upwardly against the biasing action of the spring 42 and the formation 34 is thereby disengaged from the apertures 38. As noted the bolt moves to the locked position under the action of the key and the spring 62;
6. with the bolt in the withdrawn position shown in FIG. 4 the cam must be rotated so that it is moved from the illustrated position at which it is partly under the upper end of the arm 40 to a position at which it again bears on the upper surface 72 of the arm. The arm is then forced downwardly to pivot the lock levers upwardly so that the formation 34 is disengaged from the apertures 38. In this instance the spring 62, alone, exerts force on the bolt to move it to the locked position;
7. with the bolt in the position shown in FIG. 4 the handle 20 can be moved freely to move the catch 82 in or out, in a conventional manner, and no interaction with the bolt takes place. When the bolt has been released, as is illustrated in FIG. 2, the handle 20 can also be moved freely but in this instance the bolt and the catch 82 are moved in unison. In the FIG. 1 position however the bolt is prevented from moving by the engagement of the formation 34 with the apertures 38 in the lock levers. If an attempt is made to rotate the handle 20 then the spigot 60 will not engage with hook formation 54, since the whole spring 50 is in its relaxed position, and in this relaxed position the hook is out of reach of the spigot 60. When the cam is engaged as shown in FIG. 2, the spigot 60 will engage with the hook formation 54 when the handle is operated. A situation may however arise where the bolt will not be able to move freely, such as a skew door that places a force on the bolt. Damage to the assembly can therefore arise if excessive force is exerted on the handle. Any appropriate technique may be adopted to reduce the likelihood of damage arising in this way. A suitable approach is to connect the handle 20 to the axle 18 using a clutch type device which is capable of transmitting limited force only. The force is in excess of that which is required to move the bolt from the locked to the unlocked position. If the bolt is restrained from moving in this way then, once the force level is exceeded, the clutch mechanism slips and the handle is moved downwardly without transmitting excessive force to the bolt.

FIGS. 6 to 10 illustrate a second embodiment of the invention. Where applicable reference numerals which are the same as the reference numerals used in the embodiment of FIGS. 1 to 4 are used in FIGS. 6 to 10 to indicate like components. The following description is confined essentially to differences in the forms of construction.

The spring 42 is dispensed with. The shaped spring 50 is supplemented by a leaf spring 100. The levers 36 include cam formations 102 and, optionally, an additional leaf spring 104.

It is apparent that the motor which is used in the lock of the invention is extremely small to enable it to fit in the available space inside the housing 12. The motor is also small so that power consumption is reduced. This has the natural consequence that the motor has relatively low torque.

The motor drives the motor cam via a gearbox and the motor cam drives the arm 40.

In the FIG. 1 embodiment the spring 42 acts permanently on the levers, resiliently connecting the levers to the housing. Thus a fairly significant load is at all times transferred to the arm 40 and the cam 66 must work against this force when it is rotated. This results in an increase in power consumption. It is therefore desirable to reduce the force against which the cam 66 must operate during action of the cam on the arm.

The embodiment shown in FIGS. 6 to 10 is designed to reduce power consumption but, at the same time, provide spring loading on the levers 36, when required.

The leaf spring 100 forces the levers 36 downwardly but with moderate pressure. More force is required when the levers must be returned to the unlocked position shown in FIG. 8. At this time the leaf spring 100 bears against cam formations 102 on the levers exerting a larger force on the levers which urges the levers to return to the unlocked positions. The leaf spring 100 only engages with the cam formations 102 when the bolt has been retracted to a position which is beyond a retracted normal, unlocked position at which the bolt no longer exerts a locking function. The bolt is able to move slightly beyond the retracted position by a further amount, when the handle 20 is fully turned, and then returns to the normal unlocked position when force on the handle is released.

When the bolt 22 is returned to its normal unlocked position, the leaf spring 100 is no longer in contact with the cam formations 102 and a relatively low force is again applied to the levers 36 via the leaf spring 100. This is important for, as has been noted, when relatively low force is applied to the arm 40 the cam 66 can be turned comparatively easily and pivot the arm, and hence the levers, when the bolt is to be restored to the locked position.

Use may also be made of the additional leaf spring 104 which is fixed to the levers 36 and placed so that the catch formation 34 on the bolt 22 can engage with the spring 104 under certain circumstances. The spring only exerts a force on the levers 36 when the bolt has been moved beyond the normally unlocked position to a fully retracted position by fully rotating the handle 20.

Figure 8:
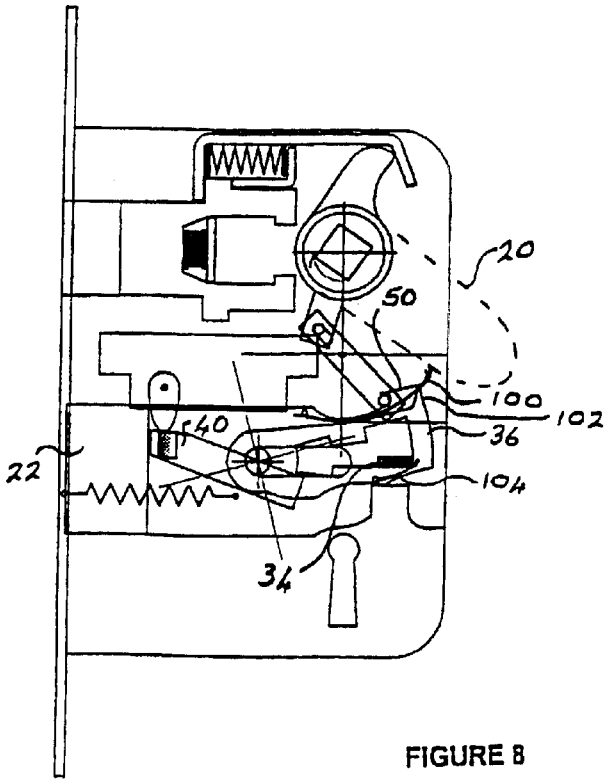
Figure 9:
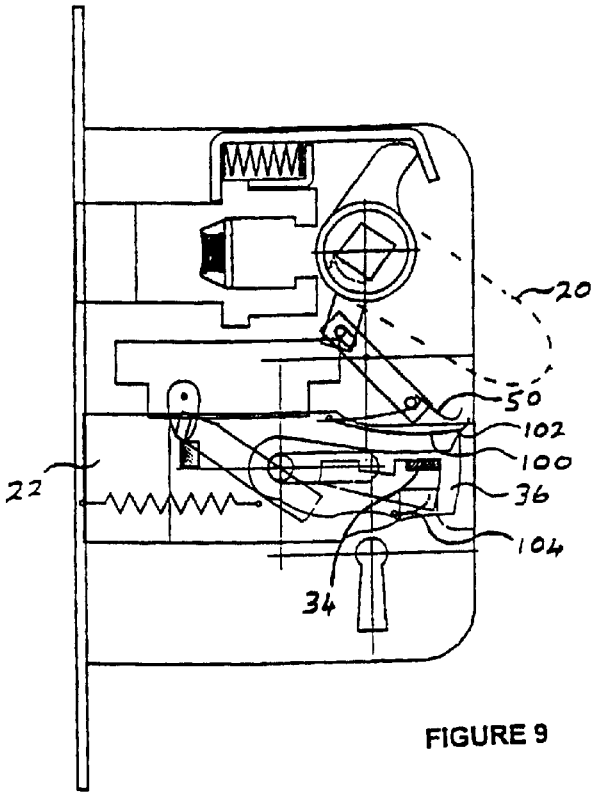
Figure 10:
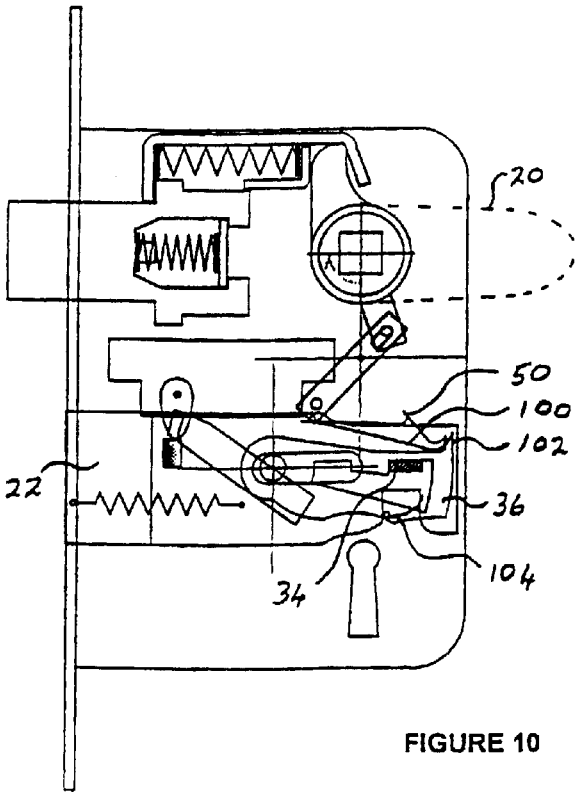

When the catch formation 34 abuts the spring 104, see FIG. 8, an additional force is exerted on the levers 36 urging the levers to pivot downwardly to a locked position.

It is to be noted that the formation 34 only acts on the spring 104, and hence on the levers 36, when the bolt 22 has been moved beyond its normal retracted or unlocked position. Thus when the cam 66 is rotated in order to restore the bolt 22 to a locked position the spring 104 does not make contact with the formation 34.

The spring 104 is a preferred item for it enables a yielding force to be exerted by the formation 34 on the lever 36. It can however be replaced by a substantially solid unyielding element and, as before, the formation 34 will, when contacting such element, urge the lever 36 to pivot downwardly. This type of construction may however create additional stress on other components of the lock.

The arrangement of FIGS. 6 to 10 therefore enables the spring force which is exerted on the arm 40 to be reduced during most of the time interval for which the cam 66 acts on the arm. However, at limiting points, the additional spring force exerted from the leaf spring 100 and the leaf spring 104 (when this second leaf spring is used) ensures a more positive locking action of the levers 36.

FIGS. 11 to 14 illustrate a lock 210 according to a third form of the invention from the side in different operating configurations which are described hereinafter. Reference numerals used in connection with the first form of the invention are used to designate like components and the following description is directed mainly to points of difference between the two embodiments.

A spring 250 has opposing ends fixed to the power lever 46 and an anchor point on the housing, respectively.

A catch 252 which has a hook formation 254 is pivotally fixed to a point 256 on the bolt. A spring 258 acts between the catch 252 and the housing.

The hook formation 254 is adjacent a spigot or similar formation 260 on the power lever 46.

A spring 262 acts between the bolt 22 and the housing or the face plate 14.

A leaf spring 264 has one end fixed to the catch 252. The opposing end of the leaf spring is free. The leaf spring however bears on a cam 266 which is mounted for rotation about an axis 268. A small electric motor 270 is used to rotate the motor cam.

The motor cam opposes a recessed formation 272 in upper end surfaces of the arms 40 of the levers, and a triangular-shaped bolt cam formation 274 on an upper side of the bolt.

A micro-controller 276 which includes a receiver and decoder unit is mounted inside the housing. This unit draws power from a battery 278 which is shown mounted inside the housing.

The micro-controller 276 and the battery 278 may, according to requirement, be mounted in an enclosure (not shown) which is separate from the housing 12 and which is relatively easily accessible.

Figure 11:
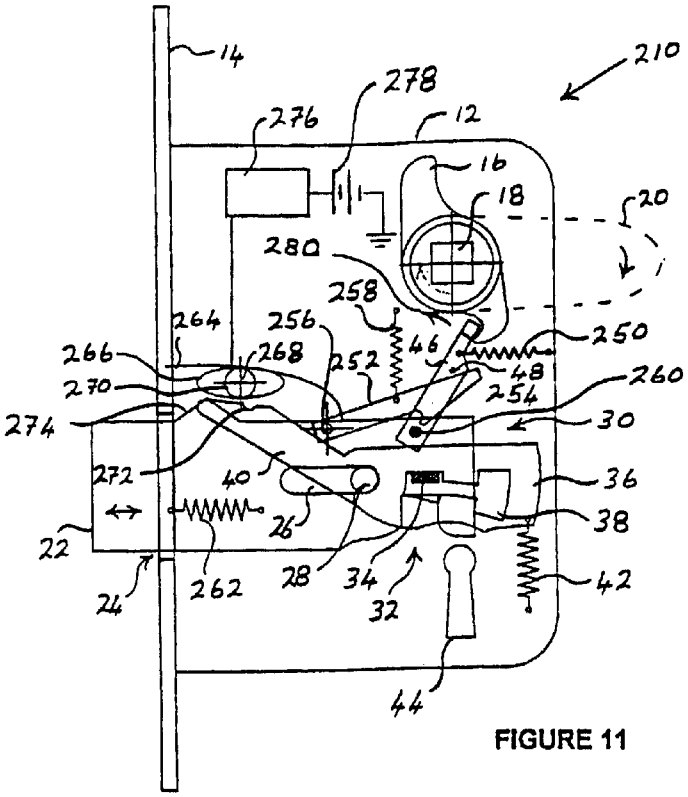
FIG. 11 illustrates a lock according to a third form of the invention in a locked configuration.

FIG. 11 illustrates the lock in a position with the bolt 22 extending from the housing. If the lock is installed in a door then clearly the bolt 22, in the illustrated position, is engageable with a striker plate on a door frame in order to keep the door in a closed and locked position.

If the lock is to be operated electronically then a user presses an unlock button on a remote control device such as a radio transmitter. Again it is to be noted that the use of a radio transmitter, for controlling the operation of the lock, is given merely by way of example and that any suitable remote or non-contact method, eg. a keypad, magnetic card or similar device, can be used for actuating the lock. An actuator of this type may more generally be referred to as an electronic key. The electronic key ideally has the facility for making use of a coded signal which is decoded by the unit 276 to enable locking and unlocking operations to take place. If an incorrectly encoded signal is received then the lock will not be operated. Clearly this is a security feature.

If the receiver recognises a transmitted code then the motor 270 is driven with power drawn, for this purpose, from the battery 278. The motor acts on the cam 266 through a gear box or similar lever arrangement and turns the cam through 90°.

Figure 12:
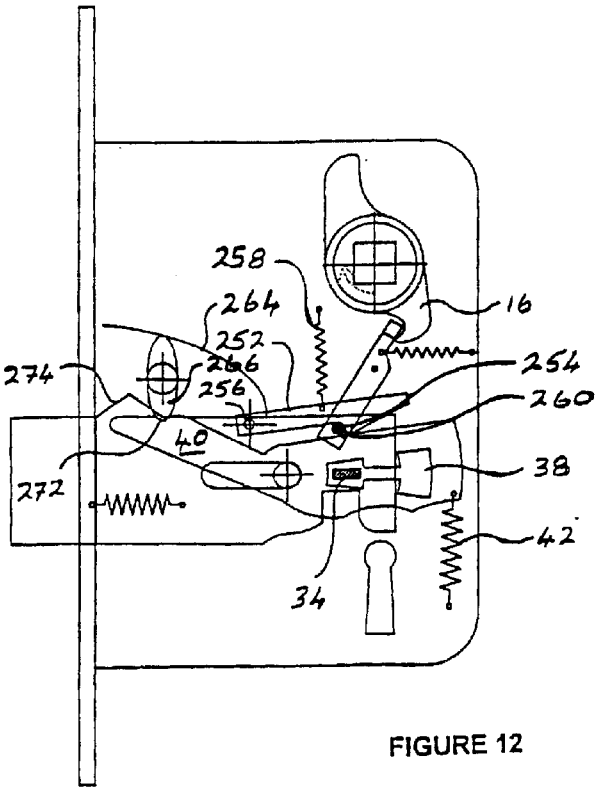
FIG. 12 shows the lock of FIG. 11 in a locked, but ready to open, configuration.

As the motor cam rotates it bears downwardly on the arms 40 of the levers which are then moved to the FIG. 12 position at which the bolt catch 34 is centrally positioned in the shaped apertures 38. This makes it possible for the bolt to be moved from the locked position shown in FIG. 11.

The motor cam also bears on the leaf spring 264. The leaf spring is extended upwardly and the catch 252 is thereby urged downwardly, pivoting about the point 256 and, at the same time, acting against the spring 258. The catch formation 254 is thus moved to a position at which it can engage with the spigot 260 on the power lever.

If one of the handles 20 is now pushed downwardly then the cam 16 causes the power lever 46 to pivot about the pivot point 48 in the direction of an arrow 280, see FIG. 11. The spigot 260 is rotated together with the lower end of the power lever, and pulls the power lever to the right in FIG. 11, thereby moving the bolt to an unlocked position at which the bolt is fully retracted into the housing. In this form of the invention the bolt is guided in this movement by the pin 28 which is located in the elongate slot 26. It is to be understood though that any other guide device may be used in place of the pin 28.

As the bolt is retracted into the housing the bolt spring 262 is extended and energy is thereby stored in the spring.

Initially the motor cam 266 is engaged with the recessed formation 272 in the lever arms 40.

Figure 13:
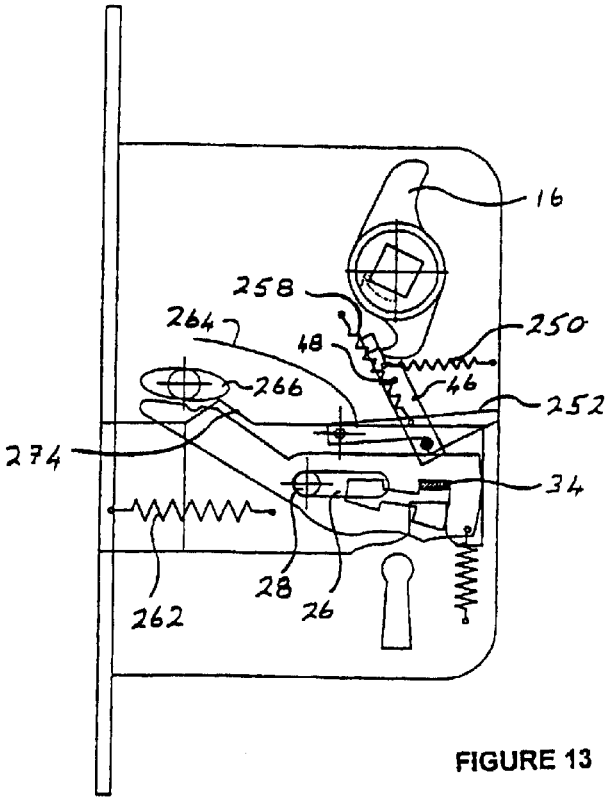
FIG. 13 shows the lock of FIG. 11 with a bolt in an unlocked position but with a handle cam, which is used to move the bolt, in an operative position.

However as the bolt slides into the housing the bolt cam formation 274 causes the motor cam 266 to rotate in an anti-clockwise direction. This allows the spring 42 to act on the levers 36 and pivot the levers in a clockwise direction so that the bolt catch 34 is again moved into engagement with the shaped apertures 38, as is shown in FIG. 13. Despite the restoring action of the spring 262, which is extended, the bolt cannot move to the left, relatively to the housing, for the bolt catch 34 prevents this movement.

The power lever 46, which is acted on by the spring 250, which is now extended, attempts to rotate in a clockwise direction about the pivot point 48. It is however prevented from rotating for the spigot 260 is engaged with the hook formation 54 and is kept engaged in this way while the handle 20 is fully depressed.

When the handle is released it rotates upwardly under the action of an internal spring, not shown. The cam 16 then no longer prevents the power lever 46 from being rotated by the spring 250 and the spigot 260 is consequently moved out of engagement with the catch formation 254. The spring 258 then acts on the power lever catch 252 which is pivoted upwardly.

If the handle is rotated fully a pin or stop formation acts on the cam 16 to prevent excessive rotation of the handle. This prevents excessive force being exerted by the catch 34 on inner sides of the apertures 38.

Figure 14:
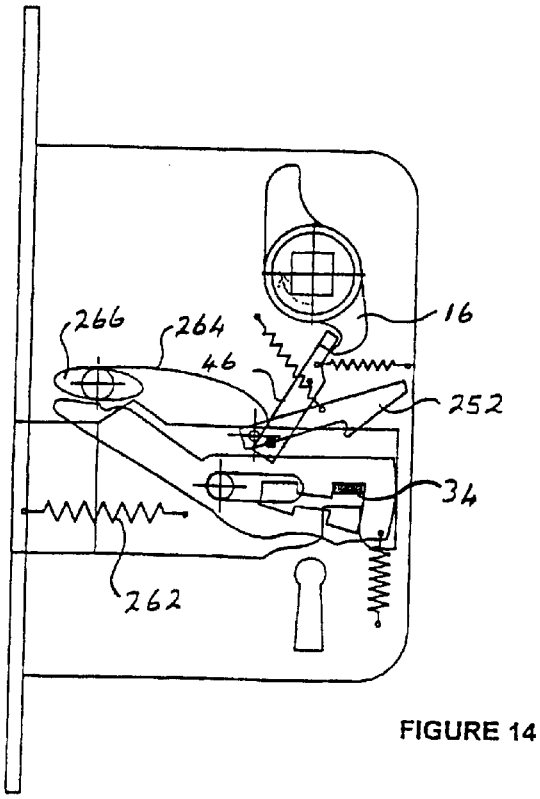
FIG. 14 is a view similar to FIG. 13 but with the handle cam in an inoperative position.

The lock is now in an opened position as shown in FIG. 14.

The bolt may be moved to the locked position, shown in FIG. 11, in two ways.

In the first instance a key may be inserted into the keyhole 44 and rotated in a conventional manner, which is known in the art. The key acts on the levers 36 and urges the levers upwardly so that the shaped apertures 38 are moved out of engagement with the bolt catch 34, substantially as is shown in FIG. 12. Further rotation of the key brings the key into engagement with the recessed formation 32 in the bolt and the bolt is moved to the left, relatively to the housing, to the locked position.

The lock may also be actuated electrically, again by making use of the transmitter already referred to. The user presses a lock button on the remote control device, or electronic key, and if the receiver and decoder unit 26 recognises the transmitted code the door locking mechanism verifies that the door is closed. If the door is closed the motor cam 266 is rotated through 90° by means of the motor 270. The motor cam 266 acts on the lever arms 40 which are thereby pivoted about the pivot pin 28 in precisely the same way as occurs when the key acts on the lock levers.

The motor cam 266 lifts the lock levers out of engagement with the bolt catch 34 which is then positioned centrally in the shaped apertures 38. The spring 262 can then urge the bolt to the left, to the locked position. As the bolt slides out of the housing the bolt cam formation 274 releases the motor cam and the system is thereby returned to the configuration shown in FIG. 11 with the bolt catch 34 again engaged with the shaped apertures 38.

The cam 266 has been described as being movable under the action of an electric motor 270. This is not essential for the cam can be moved using any other suitable actuator such as a solenoid. As is the case with the embodiments already described, an important aspect of the invention however lies in the fact that the cam acts only to move the retaining means which is engaged with the bolt, and does not move the bolt itself. The bolt is manually moved by a user from the locked to the unlocked position and, at the same time, energy is accumulated in the spring 262 which energy is subsequently available, when required, in order to move the bolt from the unlocked to the locked position.

Figure 15:
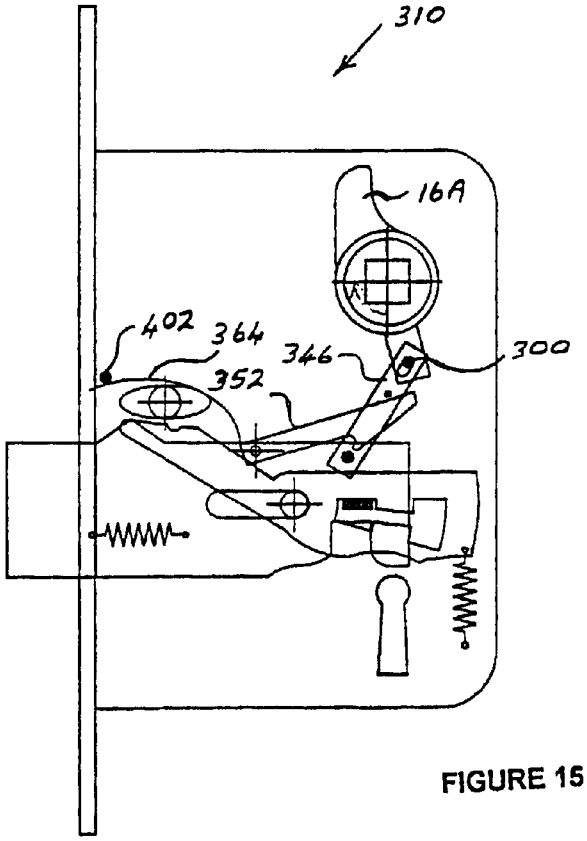
FIG. 15 illustrates a modified lock according to the invention, FIG. 16 schematically depicts certain electronic components used for controlling the operation of the lock of the invention.

FIG. 15 shows a modified lock 310 according to the invention wherein the lever 46 is replaced by a lever 346 which is pivotally connected to a cam 16A at a pivot point 300.

The springs 250 and 258 of FIG. 11 are dispensed with. A leaf spring 364 is fixed to a catch 352 and bears against a stop 402.

In other respects the lock 310 is similar to the lock 210 and operates in a similar way, but is of a simplified construction.

Figure 16:
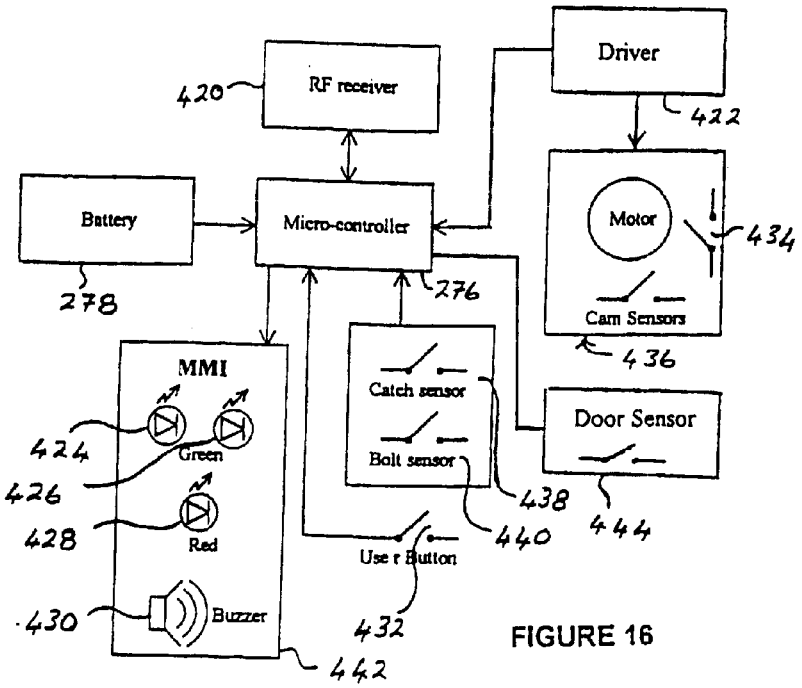

FIG. 16 schematically depicts electronic components which are used to control the operation of the lock of FIG. 11 and to provide an interface between the lock and a user. It is apparent however from the ensuing description that the two embodiments of the lock can be controlled in a similar way.

The block diagram of FIG. 16 illustrates the main electronic components required for lock operation. These components include the micro-controller 276, a radio frequency receiver circuit 420, the battery 278 which is used to power the electronic components, a driver 422 for the electric motor 270, two green LED's 424 and 426 respectively, a red LED 428, a buzzer 430, a press button 432 and sensors 434, 436, 438 and 440 which respectively are used for sensing the position of the motor 270, the cam 266, the catch of the lock (if a catch is used), and the bolt 22.

The movement of the motor 270 is controlled by the micro-controller 276 and the sensors 434 and 436 are used in a feedback mode to give information on the position of the cam 266 and to control the movement of the cam through the required angle.

Alternatively use is made of a mechanical stop and the motor is operated for a predetermined period of time which is more than sufficient to bring the cam into engagement with the stop. This controls the position of the cam.

An overload sensor could also be used to monitor the current drawn by the motor to determine when the cam is in contact with the stop, and then to interrupt the power supplied to the motor.

The micro-controller controls the operation of the buzzer 430 and the operation of the LED's 424 to 428. The components 424 to 430 are used as an interface 442 between the lock and a user and provide status information on the lock to a user. As has been noted the lock may be remotely operable from diverse sources, including signals transmitted by radio transmitters. These signals are received by the receiver 420 and they are used to place the lock into a locked or unlocked mode.

The sensor 440 is used to detect whether the bolt is in a locked or unlocked position. The sensor is also capable of detecting whether a user has used a key to lock or unlock the bolt. The function of a sensor 444 is to ensure that the bolt 222 can only be released or moved to a locked position when the door is closed.

The interface 442 is used, as has been indicated, to provide status information on the lock to a user.

The two green LED's 424 and 426 are connected in parallel. The LED 424 is mounted so that it may be seen from an outer side of the door to which the lock is attached while the LED 426 is visible from the interior side of the door. The red LED 428 is mounted so that it can be seen only from the interior side of the door. The buzzer 430 is mounted so that it can be heard from each side of the door.

If the lock is placed into an unlocked mode the green LED's are energized for a few seconds indicate that the lock has been successfully placed into the unlocked mode and the buzzer 430 gives a short buzz to provide an audio indication of the successful operation of the lock. The two green LED's and the buzzer are then switched off.

If the lock is placed into a locked mode then the red. LED 428 flashes rapidly for a brief period to indicate that the lock has been successfully placed into the locked mode and the buzzer 430 generates a long buzz. Thereafter the buzzer switches off but the red LED flashes periodically to provide a continuous indication that the lock is in a locked mode.

The detection of any user errors or internal errors is indicated by means of the buzzer and a specific combination of LED flashes.

The press button 432 is mounted on the interior side of the lock. This button is used for the manual locking or unlocking of the lock, or to place the lock into a "learn" mode so that a new transmitter code may be learnt by the lock i.e. stored in the lock.

Figure 17:
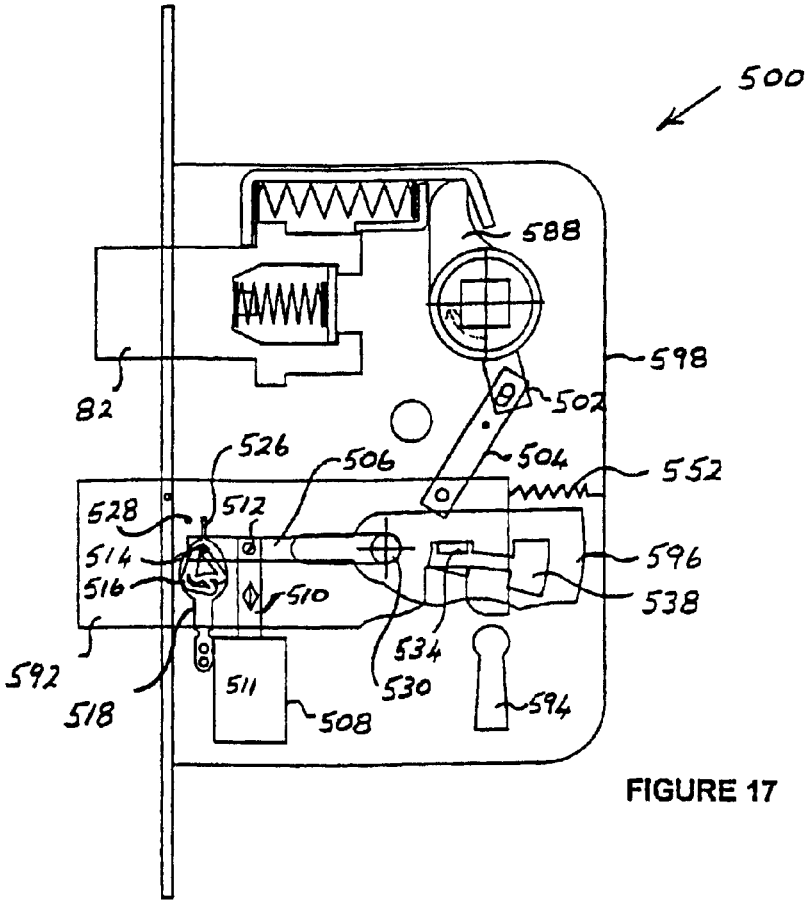
FIG. 17 shows another embodiment of a lock according to the invention which is operated using a solenoid.

FIG. 17 illustrates a lock 500 according to a different form of the invention wherein a solenoid is employed in place of a motor.

The following description is essentially directed to points of difference in the construction of the lock.

A cam 588 has an extension piece 502 and a link 504 is pivotally connected to the extension piece and to a bolt 592.

The link 504 is not permanently engaged with the bolt 592. When the levers 596 move upwardly, the levers 596 press the link 504 onto the bolt 592, engaging the link 504 with the bolt 592. If the handle is now operated, a force is applied to the bolt 592 via the link 504. When the levers 596 are released, and return to the initial position shown in FIG. 17, the levers 596 release the link 504 and the link 504 then disengages from the bolt 592. If the handle is now operated, the link 504 moves freely, without exerting force on the bolt 592.

A member 506 extends from the levers 596 to one side of the guide pin 530.

A solenoid 508 is fixed to the housing 598. The solenoid has a rod 510 which extends from a housing 511 of the solenoid and an upper end of the rod is attached at a point 512 to the member 506. The member carries a pin 514 which is engaged with a shaped channel 516 formed in a complex cam 518 which is shown in enlarged detail in FIG. 18.

The cam is mounted on an upper end of a limb 520 which includes fixing formations 522 whereby the cam is secured to the housing 511 of the solenoid. Alternatively the cam could be fixed to the housing 598. The limb is formed with recesses 524 which define a zone of weakness in the limb.

As has been noted, the pin 514 is located in the channel 516. The channel has a complex shape and is designed to cause movement of the pin, and hence of the member 506 and the levers 596, in a predetermined manner.

A projection 526 extends from an upper end of the cam 518. A protruding rod 528, see FIG. 17, extends laterally from the bolt 592 and is positioned so that if the bolt is slid, to and fro, the rod strikes the projection 526.

The solenoid 508 replaces the motor 270 shown in FIG. 11. When the solenoid is energized the rod 510 is retracted and the member 506 is pivoted downwardly, moving about a guide pin 530. The levers 596 then move upwardly and apertures 538 are thus displaced, relatively to a stop formation 534, to a position at which the bolt can be moved with a sliding action. The pin 514, which is carried on the member 506, is thereby caused to move within the channel 516. Although the limb 520 is essentially rigid the zone of weakness which is formed by the formations 524 enables the limb to flex so that the pin Is able to move inside the channel in a guided and controlled manner.

The rod 528, which is carried by the bolt 592, is positioned so that, upon movement of the bolt, it strikes the projection 526 and thereby deflects the cam to one side, as the limb flexes about the zone of weakness.

Figure 18:
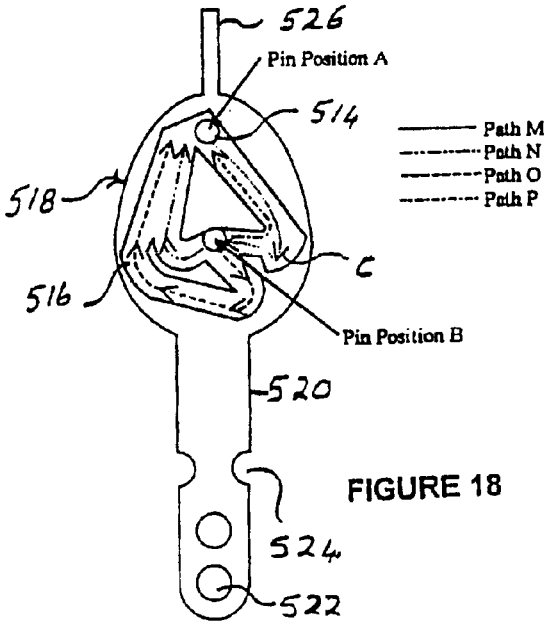
FIG. 18 is an enlarged view of a complex controlling cam used in the lock of FIG. 17, and FIGS. 19 and 20 are respective flow chart representations of operations for unlocking and locking the lock of FIG. 17.

FIG. 18 illustrates four possible paths, designated M, N, O and P respectively, which the pin 514 can take when travelling inside the channel 516.

Figure 19:
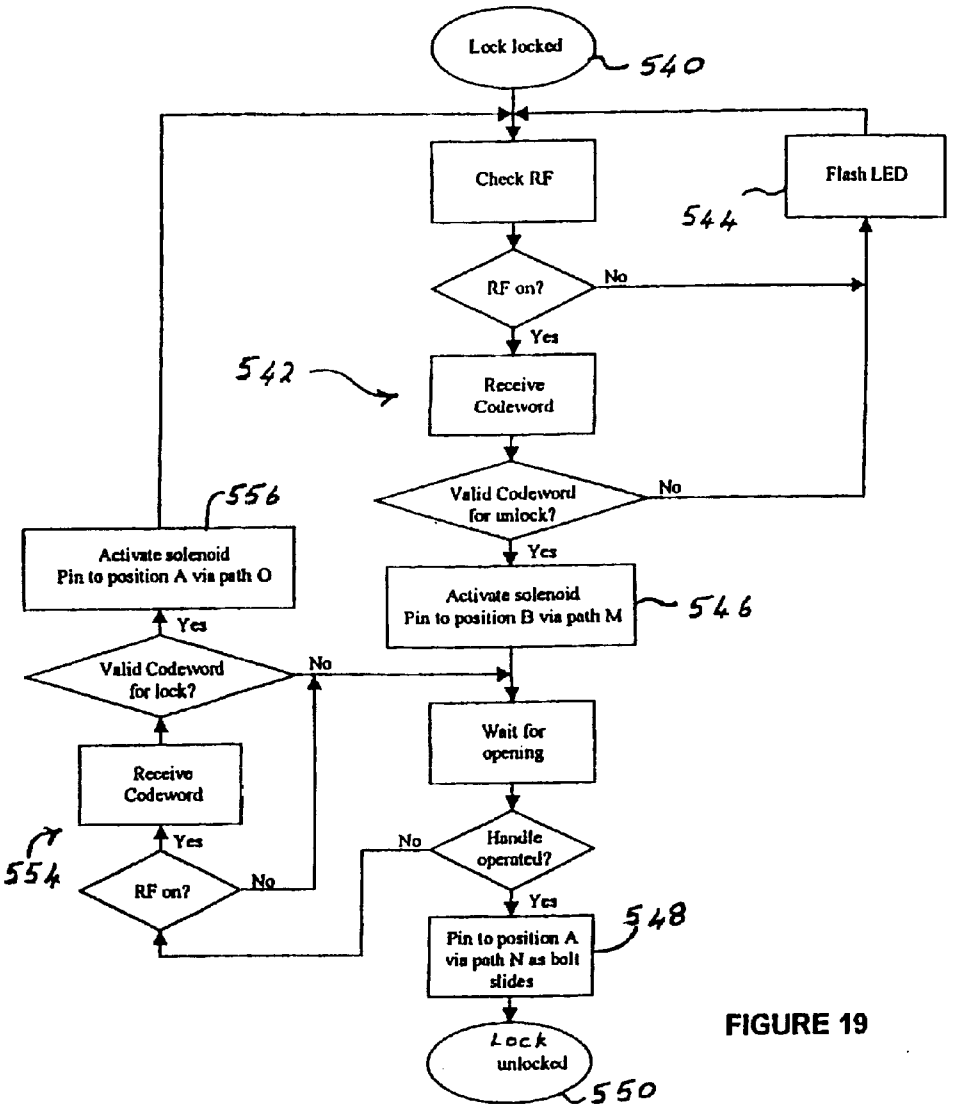

FIG. 19 is a flow chart representation of various steps when unlocking the lock 500 which initially is in a locked state 540.

As has previously been explained a validation procedure 542 is carried out when a remotely transmitted signal is received by the lock. If a valid codeword is not received, or if no codeword is received, then an LED is caused to flash (step 544). If a valid codeword is received then in a step 546 the solenoid 508 is activated and the rod 510 is drawn downwardly. The pin 514 moves to position C, see FIG. 18, travelling along the path M. As has been stated this movement is allowed for in that the limb 520 can flex about its zone of weakness. The member 506 is also drawn downwards, and the levers 596 are displaced upwardly to positions at which the sliding movement of the bolt is no longer prevented by the engagement of the formation 534 with the apertures 538.

When the solenoid is deactivated, the pin 514 continues to travel along path M to position B.

The lock stays in this position indefinitely with further opening action only taking place if the handle, which works on the cam 588, is operated. When this occurs the bolt is slid to the right in FIG. 17, by virtue of the link 504 which connects the bolt to the cam, and the pin 514 moves from position B to position A. As the bolt moves to the right the rod 528 acts on the projection 526 and causes the limb 520 to flex so that the pin 514 is able to move inside the channel 516 to return to the position A, via the path N (step 548). The lock is then in an unlocked mode 550.

When the bolt is moved to the unlocked position energy is stored in a spring of any appropriate kind. In this instance a spring 552 is positioned between an end surface of the bolt and an opposing surface of the housing. The spring is held in the compressed state for the stop formation 534 is engaged with the apertures 538 in the lever and the bolt cannot therefore return to the extended position.

With the lock at position B, and if the handle has not been operated but a remote signal is received by the lock, then if a valid codeword is identified in a validation procedure 554 the solenoid 508 is again energized in a step 556. The bolt 592 is in the position shown in FIG. 17 as the handle has not been operated. When the solenoid is energized the rod 510 is drawn downwardly, pivoting the member 506, and the pin 514 therefore travels from the position B further downwardly into the cam and then returns to the position A via the path O. The lock is therefore restored to the fully locked position 540.

Figure 20:
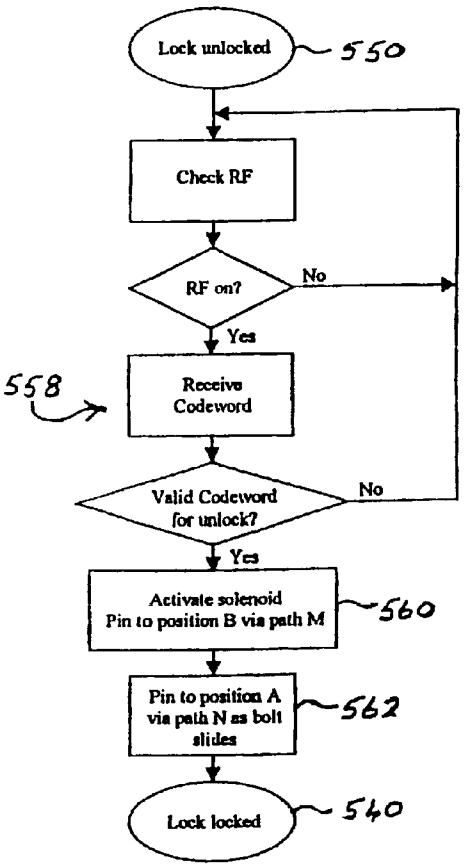

FIG. 20 illustrates the operations which are carried out when the lock 500 is returned from an unlocked mode 550 to a locked mode 540. A remotely transmitted signal is again subjected to a validation procedure 558 and if a valid codeword is identified the solenoid is energized in a step 560.

The pin 514 is thereby caused to travel along the path P to the position B. The member 506 pivots downwardly while the levers 596 move upwardly. The stop formation 534 is thus released from the apertures 538 and the spring 552 extends forcing the bolt to the left relatively to the housing 598. It is to be borne in mind that this movement is effected making use of stored energy previously generated by the user in opening the lock.

As the bolt moves to the left the protruding rod 528 strikes the projection 526. Thus the cam 518 is also moved to the left, flexing about the zone of weakness in the limb 520. The pin 514 therefore returns, in a step 562, to the position A moving along the path P. The lock is thereby restored to the locked mode 540.

The interaction of the pin 514 with the complex channel 516 is equivalent to that of an indexing system which enables the position of the bolt to be controlled in a precise manner. The solenoid is used in a way which is similar to that in which the motor 570 is used in that the solenoid provides the force which is used to release a retaining mechanism which prevents movement of the bolt. The movement of the bolt on the other hand is done manually using energy generated by a user. In moving the bolt from a locked to an unlocked mode sufficient energy is stored to enable the bolt, once it has been released by the retaining mechanism, to be restored to the locked mode.

What is claimed is:

1. A lock comprising:

a bolt which is movable between a locked position and an unlocked position;

first retaining means for, at a first position, engaging said bolt and retaining said bolt in the locked position;

remotely actuable release means for moving said first retaining means from the first position to a second position out of engagement with said bolt;

an energy storage device that powers said remotely actuable release means;

handle means for moving said bolt from the locked position to the unlocked position when said first retaining means is disengaged from said bolt;

energy storage means for accumulating energy as said bolt is moved to the unlocked position;

second retaining means, engageable with said bolt, for retaining said bolt in the unlocked position; and means for disengaging said second retaining means from said bolt whereupon said energy storage means causes said bolt to be moved to the locked position.

2. The lock according to claim 1 wherein said remotely actuable release means is electrically actuable in response to an externally generated signal.

3. The lock according to claim 2, further comprising at least one of a card reader, keypad, a recognition device, a switch device, and a radio transmitter, for producing the externally generated signal.

4. The lock according to claim 2, wherein said remotely actuable release means is responsive to a signal which is output by a receiver and decoder unit which, in turn, is responsive to an externally generated signal.

5. The lock according to claim 1, wherein said first and second retaining means comprise interengageable formations respectively on said bolt and on at least one lever.

6. The lock according to claim 1, further comprising a cam, a gear mechanism which acts on said cam, and an electrical motor that drives said gear mechanism, and hence said cam, in a controlled manner, for moving said first retaining means.

7. The lock according to claim 1, further comprising a key for moving said first and second retaining means.

8. The lock according to claim 1, further comprising a receiver that receives externally generated signals and wherein, upon receipt of one of the externally generated signals that is correctly encoded, said first and second retaining means are caused to move.

9. The lock according to claim 1, further comprising a cam that acts on said first and second retaining means, an electrically driven gear mechanism which is remotely controllable for causing controlled movement of said first retaining means from the first position to the second position and of said second retaining means into engagement with said bolt, said second retaining means then restraining said bolt from being moved from the unlocked position to the locked position, and means for preventing movement of said cam in at least one direction when said bolt is moved to the unlocked position.

10. The lock according to claim 9, wherein said energy storage means is also for providing energy for restoring said bolt to the locked position.

11. The lock according to claim 9, wherein said energy storage means is also for accumulating energy as said bolt is moved to the locked position and for providing energy for restoring said bolt to the unlocked position.

12. The lock according to claim 9, wherein said electrically driven gear mechanism comprises an electric motor that drives a gear arrangement and is responsive to an externally generated signal for causing operation of said electrically driven gear mechanism.

13. The lock according to claim 12, wherein said electric motor is responsive to a signal which is output by a receiver and decoder unit which, in turn, is responsive to the externally generated signal.

14. The lock according to claim 13, wherein the externally generated signal is generated by an electronic key.

15. The lock according to claim 1, wherein said bolt comprises a stop formation and said first retaining means comprises at least one lever that is engageable with said stop formation.

16. The lock according to claim 15, wherein said at least one lever is movable manually by means of a key into engagement with said stop formation.

17. The lock according to claim 1, further comprising sensor means for detecting whether a door, to which the lock is fitted, is open or closed and for allowing actuation of said bolt in a manner which depends on a position of the door.

18. The lock according to claim 1, further comprising a catch which is movable, by said handle means, from a latched to an unlatched position.

19. The lock according to claim 1, further comprising a device which is movable between a first position at which, upon operation of said handle means, said bolt is caused to move to the unlocked position, and a second position at which upon operation of said handle means, no movement of said bolt results.

20. The lock according to claim 19, wherein said device is selected from a spring and a catch.

21. The lock according to claim 19, wherein said device is movable by said first retaining means.

22. A method of operating a lock that includes a bolt, a catch and a handle, the method comprising the steps of:

causing the bolt to move from a locked position to an unlocked position when the catch is moved by means of the handle from a latched position to an unlatched position;

storing energy when the bolt is moved from the locked position to the unlocked position;

latching the bolt at the unlocked position using a retainer;

with the bolt at the unlocked position allowing the handle to act on the catch independently of the bolt;

transmitting a signal to actuate the retainer to unlatch the bolt; and allowing the bolt to move from the unlocked position to the locked position, under the action of the stored energy independently of the catch.

23. The method according to claim 22, wherein the transmitted signal is generated using an electronic key.

24. A lock comprising:

a bolt which is movable between a locked position and an unlocked position;

first retaining means for engaging said bolt to retain said bolt in the locked position;

remotely actuable release means for moving said first retaining means out of engagement with said bolt;

handle means for moving said bolt from the locked position to the unlocked position when said first retaining means is disengaged from said bolt; and a catch which is movable, by said handle means, from a latched to an unlatched position.

25. The lock according to claim 24, further comprising second retaining means for moving in response to said remotely actuable release means to a position at which said second retaining means restrains said bolt from being moved from the unlocked position to the locked position.

26. The lock according to claim 24, further comprising energy storing means for accumulating energy when said bolt is moved to the unlocked position and for providing energy for restoring said bolt to the locked position.

27. The lock according to claim 24, wherein said remotely actuable release means is electrically actuable in response to an externally generated signal.

28. The lock according to claim 27, further comprising one of a card reader, keypad, a recognition device, a switch device, and a radio transmitter for producing the externally generated signal.

29. The lock according to claim 24, wherein said remotely actuable release means is responsive to a signal which is output by a receiver and decoder unit which, in turn, is responsive to an externally generated signal.

30. The lock according to claim 25, wherein said first and second retaining means are comprised of interengageable formations on said bolt and on at least one lever respectively.

31. The lock according to claim 24, further comprising a cam, a gear mechanism which acts on said cam, and an electrical motor that drives said gear mechanism, and hence said cam, in a controlled manner for moving said first retaining means.

32. The lock according to claim 25, wherein said first and the second retaining means are movable by a key.

33. The lock according to claim 25, further comprising a receiver that receives externally generated signals and wherein, when the externally generated signal is correctly encoded, said first and second retaining means are caused to move.

34. The lock according to claim 24, further comprising an energy storage device for powering said remotely actuable release means.

35. The lock according to claim 24, further comprising a cam that acts on said first retaining means, an electrically driven gear mechanism, which is remotely controllable, for causing controlled movement of said first retaining means, energy storage means for accumulating energy as said bolt is moved, and means for preventing movement of said cam at least in one direction when said bolt is moved to the unlocked position.

36. The lock according to claim 35, wherein said energy storage means accumulates energy as said bolt is moved to the unlocked position and provides energy for restoring said bolt to the locked position.

37. The lock according to claim 35, wherein said energy storage means accumulates energy as said bolt is moved to the locked position and the energy storage means provides energy for restoring said bolt to the unlocked position.

38. The lock according to claim 35, wherein said electrically driven gear mechanism includes an electric motor that drives a gear arrangement and which is responsive to an externally generated signal for causing operation of said electrically driven gear mechanism.

39. The lock according to claim 38, wherein said electric motor is responsive to a signal which is output by a receiver and decoder unit which, in turn, is responsive to the externally generated signal.

40. The lock according to claim 39, wherein the externally generated signal is generated by an electronic key.

41. The lock according to claim 24, wherein said bolt comprises a stop formation and said first retaining means includes a lever which is engageable with said stop formation.

42. The lock according to claim 41, wherein said lever is movable manually by means of a key into engagement with said stop formation.

43. The lock according to claim 24, further comprising sensor means for detecting whether a door, to which the lock is fitted, is open or closed and to allow actuation of said bolt in a manner which depends on a position of the door.

44. The lock according to claim 24 wherein said bolt is movable in response to operation of a key and wherein said bolt includes means for disabling operation of the key.

45. A lock comprising:

a bolt that is movable between a locked position and an unlocked position;

first retaining means for engaging said bolt to retain said bolt in the locked position;

remotely actuable release means for moving said first retaining means out of engagement with said bolt;

handle means for moving said bolt from the locked position to the unlocked position when said first retaining means is disengaged from said bolt; and a device that is movable between a first position at which, upon operation of said handle means, said bolt is caused to move to the unlocked position, and a second position at which, upon operation of said handle means, no movement of said bolt results.

46. The lock according to claim 45, further comprising second retaining means for moving in response to said remotely actuable release means to a position at which said second retaining means restrains said bolt from being moved from the unlocked position to the locked position.

47. The lock according to claim 45, further comprising energy storage means for accumulating energy when said bolt is moved to the unlocked position and providing energy for restoring said bolt to the locked position.

48. The lock according to claim 45, wherein said remotely actuable release means is electrically actuable in response to an externally generated signal.

49. The lock according to claim 48, wherein the externally generated signal is produced by a card reader, keypad, a recognition device, a switch device, or a radio transmitter.

50. The lock according to claim 45, wherein said remotely actuable release means is responsive to a signal which is output by a receiver and decoder unit which, in turn, is responsive to an externally generated signal.

51. The lock according to claim 46, wherein said first and second retaining means are comprised of interengageable formations respectively on said bolt and on at least one lever.

52. The lock according to claim 45, wherein said first retaining means is movable by means of a cam, a gear mechanism which acts on the cam, and an electrical motor which drives the gear mechanism, and hence the cam, in a controlled manner.

53. The lock according to claim 46, wherein said first and the second retaining means are movable by a key.

54. The lock according to claim 46, further comprising a receiver that receives an externally generated signal and wherein, upon receipt of a correctly encoded signal by said receiver, said first and second retaining means are caused to move.

55. The lock according to claim 45, wherein said bolt is movable in response to operation of a key and comprises means for disabling operation of the key.

56. The lock according to claim 1, wherein said bolt is movable in response to operation of a key and comprisese means for disabling operation of the key.

* * * * *